US007770631B2

(12) United States Patent
Wang

(10) Patent No.: US 7,770,631 B2
(45) Date of Patent: Aug. 10, 2010

(54) METHOD FOR MANUFACTURING SUPPORTING BODY WITHIN AN ISOTHERMAL PLATE AND PRODUCT OF THE SAME

(75) Inventor: Chin-Wen Wang, 10F., No. 28, Xinfu 3rd St., Pingzhen City, Taoyuan County 324 (TW)

(73) Assignees: Chin-Wen Wang, Taoyuan (TW); Hyper-Green Industrial Co., Ltd., Taoyuan (TW)

( * ) Notice: Subject to any disclaimer, the term of this patent is extended or adjusted under 35 U.S.C. 154(b) by 261 days.

(21) Appl. No.: 12/051,166

(22) Filed: Mar. 19, 2008

(65) Prior Publication Data

US 2009/0236085 A1 Sep. 24, 2009

(51) Int. Cl.
*F28D 15/00* (2006.01)

(52) U.S. Cl. ..... 165/104.26; 165/104.21; 165/104.33; 361/700; 361/704

(58) Field of Classification Search ..... 165/104.26, 165/104.33, 104.21; 361/700, 704
See application file for complete search history.

(56) References Cited

U.S. PATENT DOCUMENTS

| | | | | |
|---|---|---|---|---|
| 3,734,173 | A * | 5/1973 | Moritz | 165/104.26 |
| 3,762,011 | A * | 10/1973 | Staudhammer et al. | 419/2 |
| 4,274,479 | A * | 6/1981 | Eastman | 165/104.26 |
| 4,899,812 | A * | 2/1990 | Altoz | 165/109.1 |
| 6,082,443 | A * | 7/2000 | Yamamoto et al. | 165/104.26 |
| 6,366,462 | B1 * | 4/2002 | Chu et al. | 361/699 |
| 6,397,935 | B1 * | 6/2002 | Yamamoto et al. | 165/104.26 |
| 2002/0020518 | A1 * | 2/2002 | Li | 165/104.11 |
| 2004/0069455 | A1 * | 4/2004 | Lindemuth et al. | 165/104.15 |

* cited by examiner

*Primary Examiner*—Terrell L McKinnon
(74) *Attorney, Agent, or Firm*—Chun-Ming Shih; HDLS IPR Services

(57) ABSTRACT

A supporting body within an isothermal plate includes a flat plate having two surfaces, and a plurality of bosses and pits arranged on both surfaces of the plate. The plate is provided thereon with a plurality of through holes. The though holes are located between the bosses and pits respectively. A portion of the bosses and pits protrudes from one surface of the plate, and the other portion thereof protrudes from the other surface of the plate.

8 Claims, 6 Drawing Sheets

METHOD FOR MANUFACTURING SUPPORTING BODY WITHIN AN ISOTHERMAL PLATE AND PRODUCT OF THE SAME

BACKGROUND OF THE INVENTION

1. Field of the Invention

The present invention relates to a heat transfer technique, and in particular to a supporting body within an isothermal plate and a method for manufacturing the same.

2. Description of Prior Art

An isothermal plate is a kind of plate-like heat pipes. The principle of the isothermal plate is the same as that of the heat pipe. Via an internal vacuum environment, a working fluid filled therein can generate phase change by being heated, thereby transferring heat. Then, the working fluid returns to the liquid state after being cooled, thereby circulating the working fluid.

However, the manufacturing process of the isothermal plate is different from that of the heat pipe. The pipe body of the heat pipe is usually formed into a tubular body. After sealing one end of the pipe body, filling with the working fluid, a degassing or vacuum-pumping process is performed via the open end of the heat pipe. When the degassing process is finished, the pipe body is closed immediately, thereby completing the manufacturing of the heat pipe. On the other hand, the plate body of the isothermal plate is constituted of two covers that are covered with each other vertically. Thus, not only the peripheries of the two covers have to be sealed, but also the supporting strength of the two covers during the degassing or vacuum-pumping process should be monitored carefully. Therefore, it is necessary to additionally provide a supporting structure in the isothermal plate, thereby preventing the two covers from being recessed.

The conventional supporting structure within the isothermal plate is constituted of a plurality of pillars arranged in the plate. Alternatively, the supporting structure is made by means of bending a thin plate continuously to form a wave-like structure. However, these conventional structures and the manufacturing processes thereof are inconvenient or not good. For example, in the case of the supporting structure made of pillars, since the pillars are separated from each other, the pillars have to be arranged in the isothermal plate one by one, which cannot be performed easily. Further, the wave-like structure made by bending a thin plate is insufficient in supporting strength, and thus the supporting effect thereof is limited.

In view of the above drawbacks, the Inventor proposes the present invention based on his expert knowledge and elaborate researches in order to solve the problems of prior art.

SUMMARY OF THE INVENTION

The present invention is to provide a method for manufacturing a supporting body within an isothermal plate and a product of the same. By pressing a plate material, the supporting body for the isothermal plate can be formed on the plate material. Since the supporting body is formed into a sheet, it can match the profile of the isothermal plate and thus can be disposed flatly in the isothermal plate. Thus, the assembling process is easy. Further, the supporting structure made by means of pressing also has enough supporting strength.

The present invention provides a supporting body within an isothermal plate, which includes a flat plate having two surfaces, and a plurality of bosses and pits arranged on both surfaces. The plate is provided thereon with a plurality of through holes. The though holes are located between the bosses and pits respectively. A portion of the bosses and pits protrudes toward one surface of the plate, while another portion thereof protrudes toward another surface of the plate. With this supporting body, the above objects can be achieved.

The present invention is to provide a method for manufacturing a supporting body within an isothermal plate, including the steps of:

a) preparing a plate material that is used as a supporting plate within the isothermal plate; and b) pressing the plate material to form a plurality of bosses and pits on the surface of the plate and a plurality of through holes between the bosses and pits respectively.

DETAILED DESCRIPTION OF THE INVENTION

In order to make the Examiner to better understand the characteristics and technical contents of the present invention, a detailed description relating thereto will be made with reference to the accompanying drawings. However, the drawings are illustrative only, but not used to limit the present invention.

Figure 1:
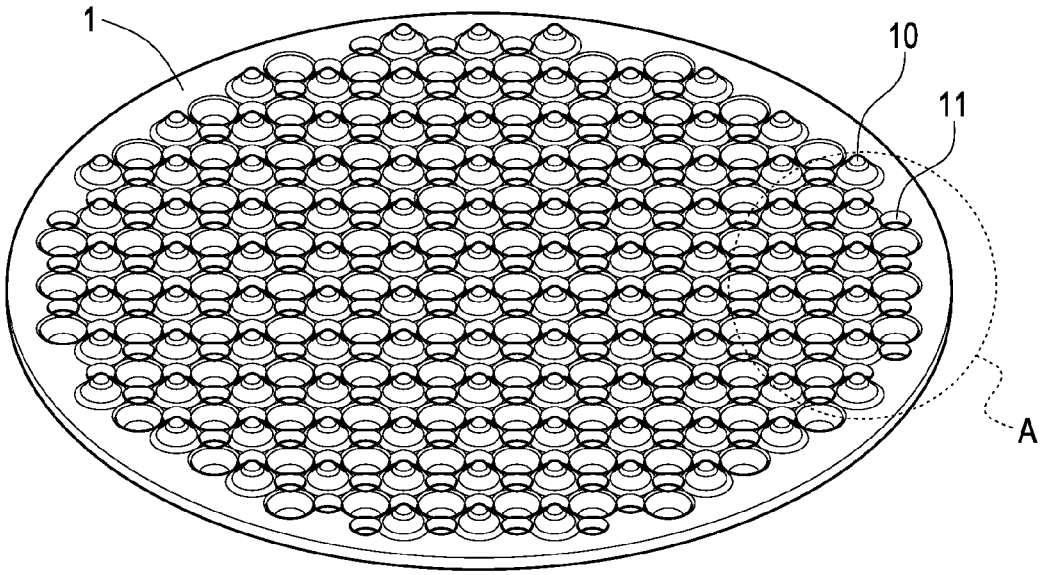
FIG. 1 is a schematic view showing the external appearance of the supporting body of the present invention.
Figure 2:
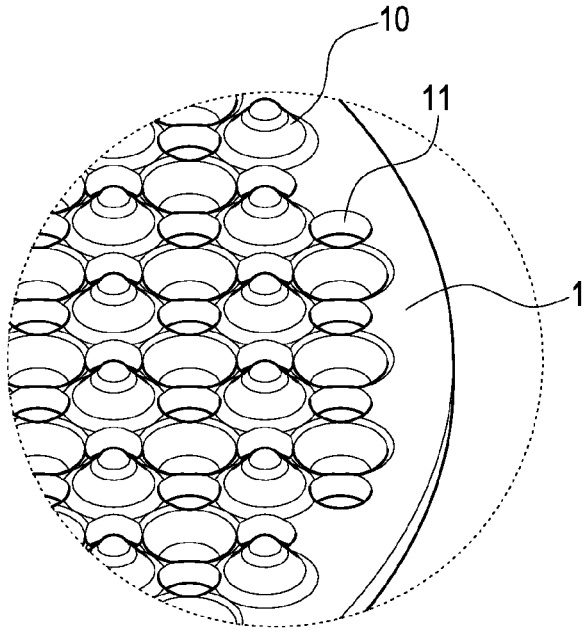
FIG. 2 is an enlarged view showing the detail of portion A in FIG. 1.
Figure 3:
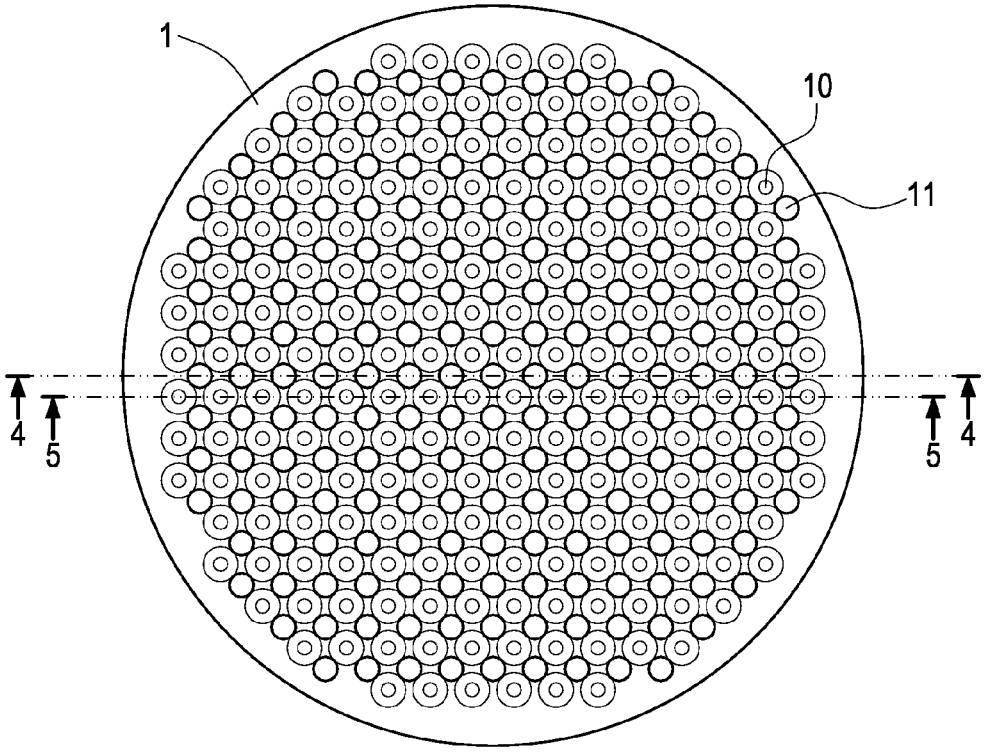
FIG. 3 is a top view showing the supporting body of the present invention.

FIG. 1 is a schematic view showing the external appearance of the supporting body of the present invention. FIG. 2 is an enlarged view showing the detail of portion A in FIG. 1. FIG. 3 is a top view showing the supporting body of the present invention. The present invention provides a method for manufacturing a supporting body within an isothermal plate and a product of the same. The supporting body has a flat plate 1. The profile of the plate 1 can be made to match up the profile of the isothermal plate. In the illustrated embodiment of the present invention, the plate is a circular plate. The primary structural characteristic of the present invention lies in that both surfaces of the plate 1 are provided thereon with a plurality of bosses and pits 10, and a plurality of through holes 11 located between the bosses and pits 10.

Figure 4:
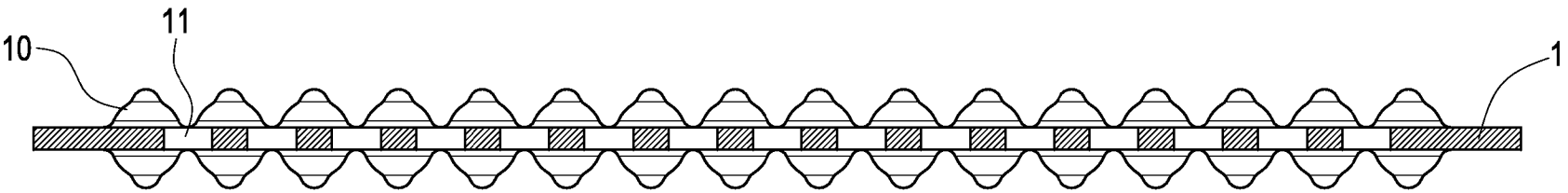
FIG. 4 is a cross-sectional view taken along the line 4-4 in FIG. 3.
Figure 5:
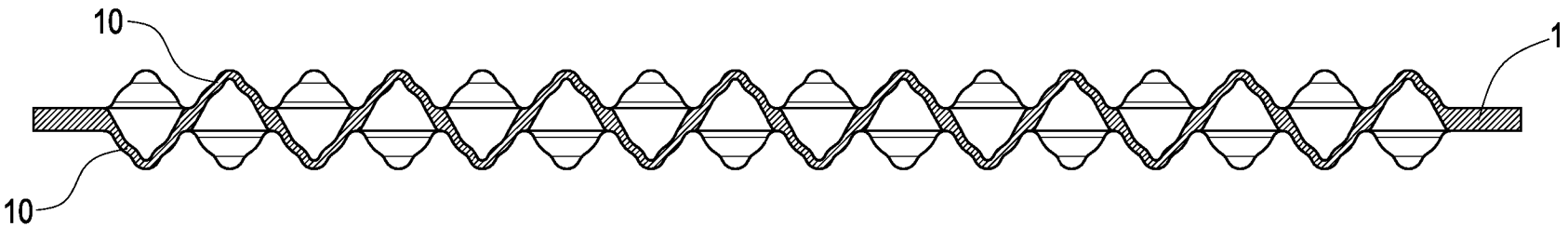
FIG. 5 is a cross-sectional view taken along the line 5-5 in FIG. 3.

Please refer to FIGS. 3 and 4. Each through hole 11 penetrates both surfaces of the plate 1 and thus acts as a channel for the vapor within the isothermal plate, or allows the working fluid sealed within the isothermal plate to pass through. Please also refer to FIGS. 3 and 5. A portion of the bosses and pits 10 protrudes from one surface of the plate 1, and the other portion thereof protrudes from the other surface of the plate 1. The bosses and pits 10 on both surfaces of the plate 1 are arranged in a staggered manner, so that the bosses and pits 10 on both surfaces of the plate 1 can be distributed evenly. In addition, the bosses and pits 10 can be formed into conical bodies that are hollowed inwardly from the bottom.

Figure 6:
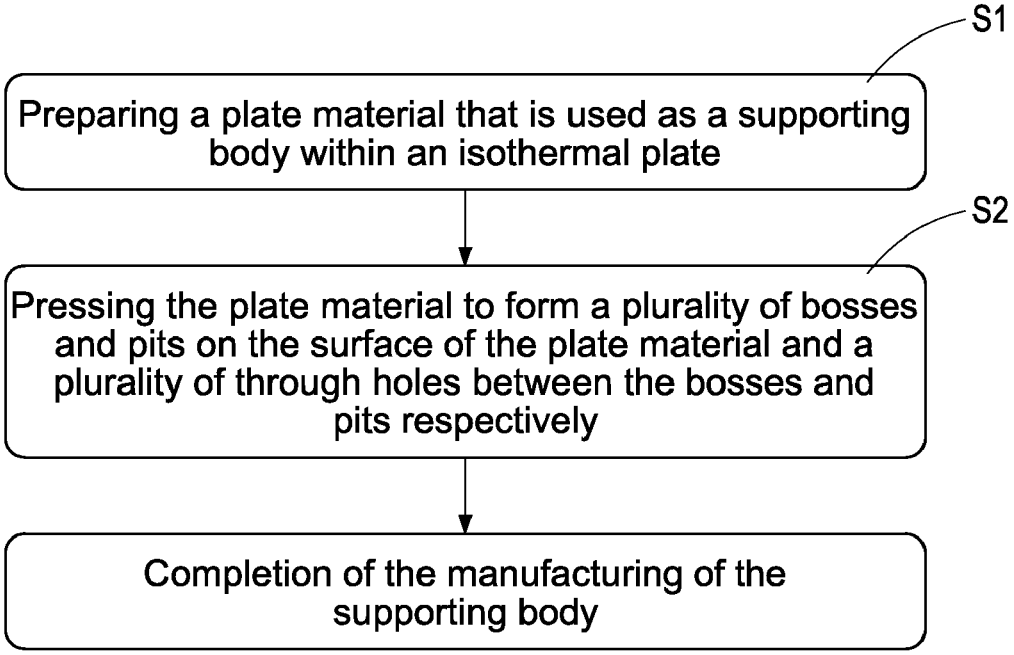
FIG. 6 is a flow chart showing the steps of the method of the present invention.

As shown in FIG. 6, the method for manufacturing the supporting body of the present invention is described as follows.

First, in the step S1 of FIG. 6, a plate material is prepared first, which can be used as the plate 1 of the supporting body within the isothermal plate. Then, in the step S2 of FIG. 6, via a pressing process, the surfaces of the plate material are formed thereon with a plurality of bosses and pits 10, and a plurality of through holes 11 located between the bosses and pits 10 respectively. In this way, the supporting body can be obtained.

Further, the step S2 can be further divided into two sub-steps. That is, after the plurality of through holes 11 is formed on the plate material, the plurality of bosses and pits 10 is formed on the plate material.

Therefore, via the above structure and steps, the method for manufacturing the supporting body within the isothermal plate and the product of the same can be obtained.

Figure 7:
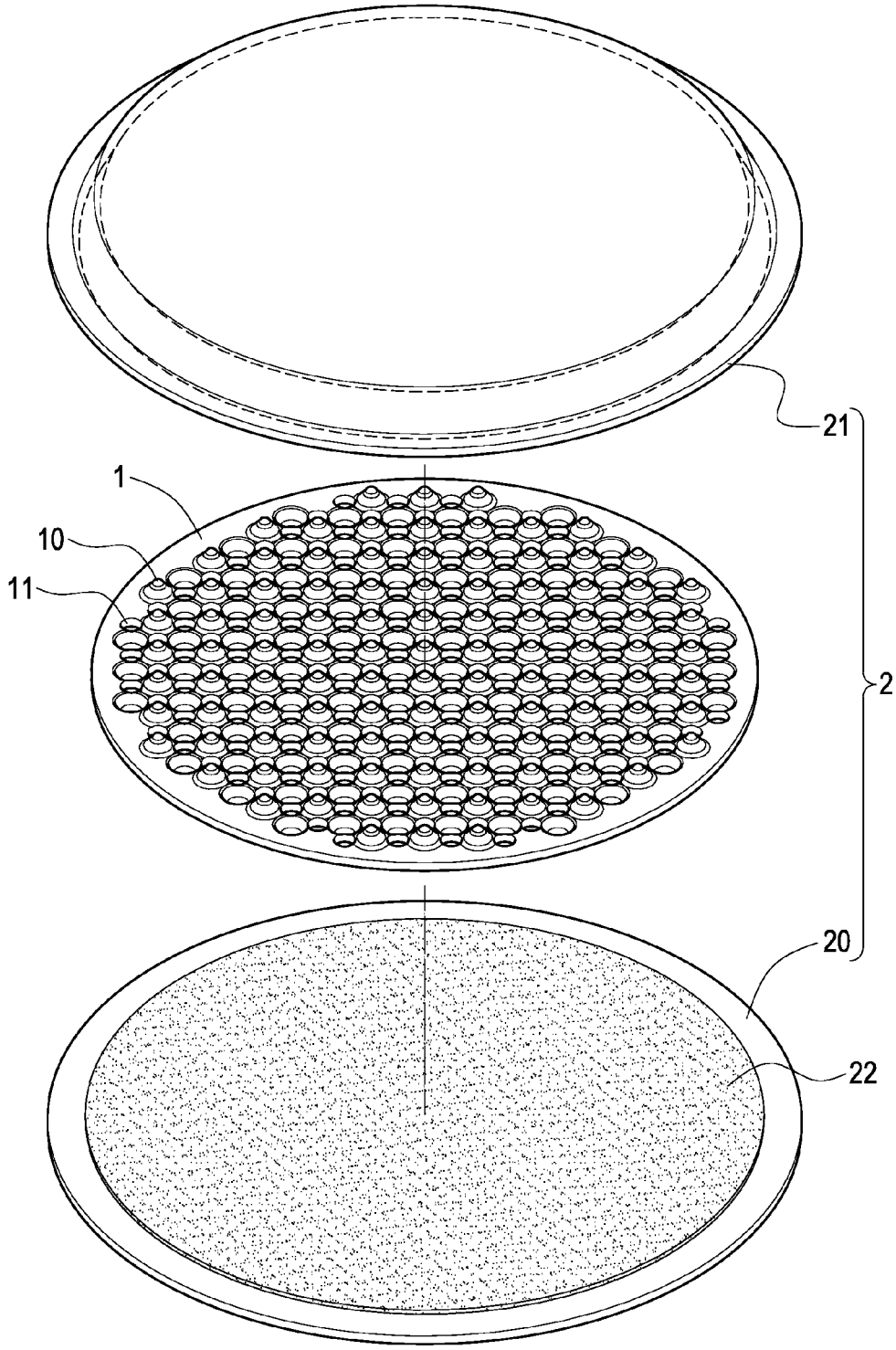
FIG. 7 is an exploded perspective view showing the supporting body of the present invention being disposed in the isothermal plate.

As shown in FIG. 7, when the supporting body is disposed in a casing 2 of an isothermal plate, the casing 2 of the isothermal plate can be constituted of two covers 20, 21 that are covered with each other. Further, the inner surfaces of the two covers 20, 21 are adhered with capillary structure 22. The supporting body is disposed flatly between the two covers 20, 21. Then, the casing 2 is sealed, thereby obtaining the isothermal plate shown in FIG. 8.

Figure 8:
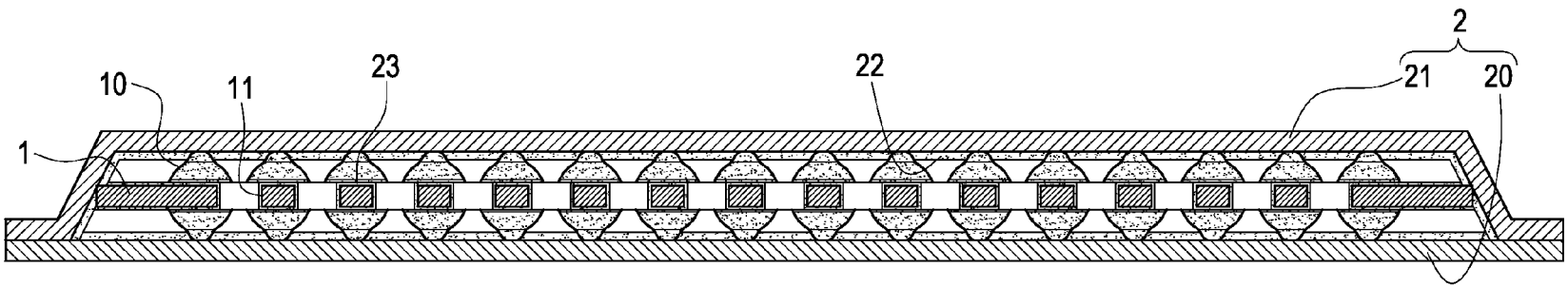
FIG. 8 is an assembled cross-sectional view showing the supporting body of the present invention being disposed in the isothermal plate.

As shown in FIG. 8, since the plate 1 of the supporting body can match the shape of the casing 2 of the isothermal plate. Thus, the plate can be flatly disposed between the two covers 20, 21, thereby facilitating the assembly and alignment. Further, both surfaces of the plate 1 are formed with the plurality of bosses and pits 10 to abut against the inner surfaces of the two covers 20, 21 of the casing 2 of the isothermal plate, thereby forming a supporting structure having sufficient supporting effect. Via this arrangement, the problem that the casing 2 of the isothermal plate may be recessed during the degassing or vacuum-pumping process can be avoided. At the same time, the plate 1 has a plurality of through holes 11 thereon to allow the working fluid within the isothermal plate to pass through the plate 1 directly during the liquid-vapor phase change. Therefore, it is not easy to affect the heat transfer effect of the isothermal plate during the phase change. Further, it is worthy to mentioned that the supporting body can be coated with capillary structure 23 made of sintered powders. The capillary structure 23 can be coated on both surfaces of the plate 1, the surface of each of the bosses and pits 10, or even the inner edge of each through hole 11, thereby facilitating the flowing of the working fluid.

According to the above, the present invention really achieves the desired objects and solves the drawbacks of prior art. Further, the present invention indeed has novelty and inventive steps, and thus conforms to the requirements for an invention patent.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An isothermal plate, comprising:

a casing constituted of two covers, that are covered with each other, inner surfaces of the two covers, being provided with capillary structure;

a plate being flat and having two surfaces, the plate being flatly disposed between the two covers; and a plurality of bosses and pits provided on the plate and distributed on the surfaces thereof, each of the bosses and pits being a conical body that is hollowed inwardly from the bottom, and a cross-section of each of the bosses and pits being circular, wherein the plate is provided thereon with a plurality of through holes, the through holes are located between the bosses and pits respectively, a portion of the bosses and pits protrudes from one surface of the plate, and the other portion thereof protrudes from the other surface of the plate.

2. The isothermal plate according to claim 1, wherein the two surfaces of the plate and the surface of each of the bosses and pits are provided with a capillary structure.

3. A supporting body within an isothermal plate, comprising:

a plate being flat and having two surfaces; and a plurality of bosses and pits provided on the two surfaces of the plate, each of the bosses and pits being a conical body that is hollowed inwardly from the bottom, and a cross-section of each of the bosses and pits being circular, wherein the plate is provided thereon with a plurality of through holes, the through holes are located between the bosses and pits respectively, a portion of the bosses and pits protrudes from one surface of the plate, and the other portion thereof protrudes from the other surface of the plate.

4. The supporting body within an isothermal plate according to claim 3, wherein both surfaces of the plate and the surface of each of the bosses and pits are provided with a capillary structure.

5. A method for manufacturing a supporting body within an isothermal plate, comprising the steps of:

a) preparing a plate material that is used as the supporting body within the isothermal plate; and b) pressing the plate material to form a plurality of bosses and pits on the surface of the plate material and a plurality of through holes between the bosses and pits respectively, each of the bosses and pits being a conical body that is hollowed inwardly from the bottom, and a cross-section of each of the bosses and pits being circular.

6. The method according to claim 5, wherein the step b) further comprises the steps of:

b-1) forming the plurality of through holes on the plate material first; and b-2) forming the plurality of bosses and pits on the plate material.

7. The method according to claim 6, further comprising a step c) of coating sintered powders on the plate material and then performing a sintering process.

8. The method according to claim 5, further comprising a step c) of coating sintered powders on the plate material and then performing a sintering process.

* * * * *